US006526705B1

(12) United States Patent
MacDonald

(10) Patent No.: US 6,526,705 B1
(45) Date of Patent: Mar. 4, 2003

(54) INTERLOCKING TILES

(76) Inventor: Kenneth M. MacDonald, 21 Poyntel Crescent, Chiselhurst Kent (GB)

( * ) Notice: Subject to any disclaimer, the term of this patent is extended or adjusted under 35 U.S.C. 154(b) by 0 days.

(21) Appl. No.: 09/763,905

(22) PCT Filed: Dec. 23, 1998

(86) PCT No.: PCT/GB98/03896

§ 371 (c)(1),
(2), (4) Date: Feb. 28, 2001

(87) PCT Pub. No.: WO99/34075

PCT Pub. Date: Jul. 8, 1999

(30) Foreign Application Priority Data

Dec. 24, 1997 (GB) ..... 9727395

(51) Int. Cl.[7] ..... B32B 3/06

(52) U.S. Cl. ..... 52/177; 428/44; 428/60; 428/53; 428/157

(58) Field of Search ..... 428/44, 53, 60, 428/157; 404/32, 33, 35, 41; 52/590.2, 591.3, 392, 177

(56) References Cited

U.S. PATENT DOCUMENTS 4,973,505 A * 11/1990 Bielous ..... 428/44

* cited by examiner

*Primary Examiner*—Alexander S. Thomas
(74) *Attorney, Agent, or Firm*—J. Wiley Horton

(57) ABSTRACT

Tiles, preferably floor tiles having an upper surface (1) which has engagement members (6) extending from two adjacent sides (2 and 3). The engaging elements (6) have a recess between them which is a mirror image of the engaging elements (6) of an adjacent tile. Rib (9) on the outer extensions (**6*a*, 6*b*, 6*c*) of the engaging elements (6) engages with slot (10) along the lengths of sides (2, 3) to form a fluid tight seal between adjacent tiles which are interlocked by engaging elements (6**).

9 Claims, 6 Drawing Sheets

INTERLOCKING TILES

This invention relates to tiles, particularly interlocking tiles which are adapted to be interlocked together to cover a surface. A preferred application of the tiles of the invention is as a floor covering.

It is known to provide rectangular or square floor tiles in which two adjacent sides have projections, the other two adjacent sides having recesses corresponding to the shape of the projections. In this way, a large number of the tiles can be interlocked to form a floor covering. Known arrangements of such interlocking floor tiles have the disadvantage that the joint where the tiles are interlocked is visible and not only detracts from the appearance of the tile inherently, but also imposes limitations on the practicality of the tile since liquid such as water can seep down the joint line between adjacent tiles. This is a particular problem in locations such as kitchens and hospitals and some factories, where a great deal of liquid is liable to be distributed over the floor.

The present invention seeks to provide a floor tile with an additional sealing arrangement which substantially prevents the ingress of water to the underside of the tiles. According to the present invention there is provided an interlocking, generally planar tile, having a four-sided, preferably square, shape with an outer face and an inner face, each side having a plurality of engagement elements interlockingly engageable with corresponding engagement elements on an adjacent tile, a first two adjacent sides having the outer surface extending over the engagement elements, an edge rib extending along the length of the side and extending downwardly away from the outer surface, on the other two adjacent sides, the engagement elements extending outwardly beyond the upper surface and having a recess extending along the length of the side, which recess is adapted to receive a said rib on a first side on an adjacent tile, the engagement of the rib in the recess forming a substantially fluid tight joint between the two tiles.

Preferably, the tile is a floor tile formed of a resilient material such as a plastics material or a natural or synthetic rubber. In an alternative embodiment, the main body of the tile is formed of a ceramic material and the engagement elements, rib and recess are formed in a peripheral seal or gasket of resilient material extending round the periphery of the tile on its underside.

The recess is preferably located at the root of the engaging elements immediately adjacent to the edge of the upper surface so that when an adjacent tile is placed on this tile, the rib engages in the recess so that the upper surfaces of the two tiles are closely abutting to substantially conceal the joint between the two tiles.

A preferred embodiment of the present invention will now be described by way of example with reference to the accompanying drawings in which.

Figure 3:
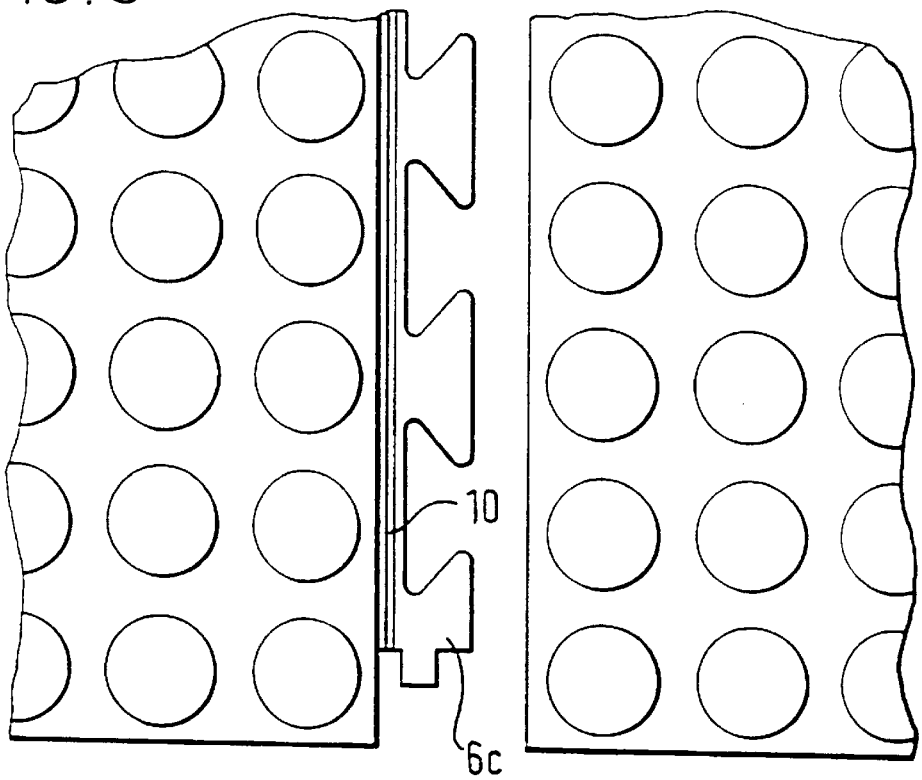
FIG. 3 shows a corner section of two tiles in greater detail.
Figure 4:
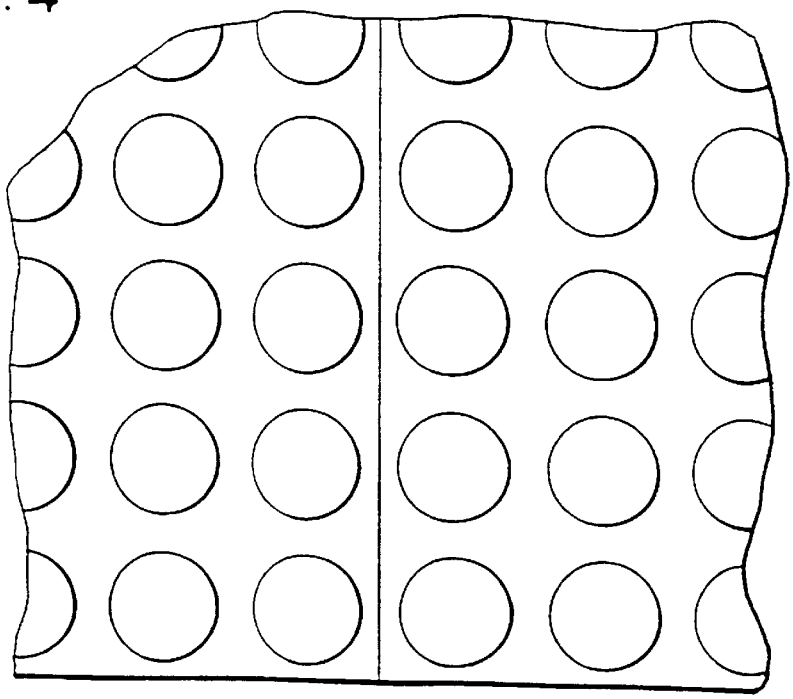
FIG. 4 shows the two tiles of FIG. 3 joined together.
Figure 5:
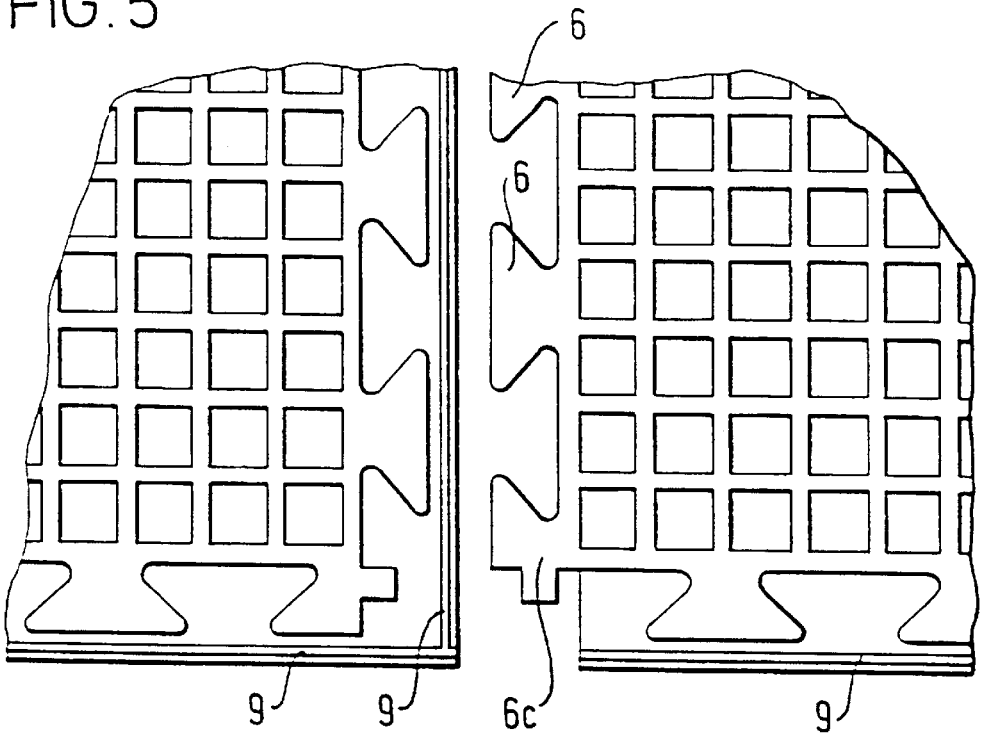
Figure 6:
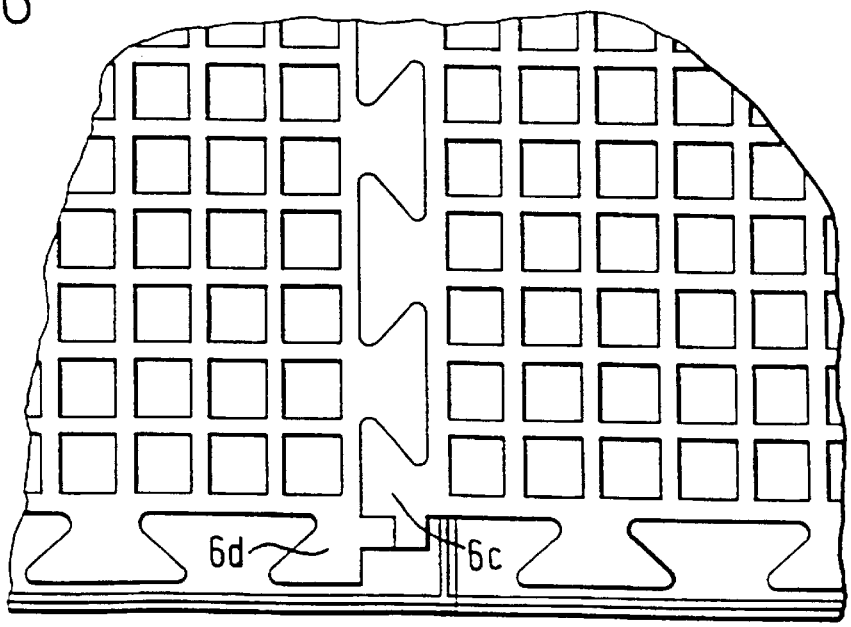
Figure 7:
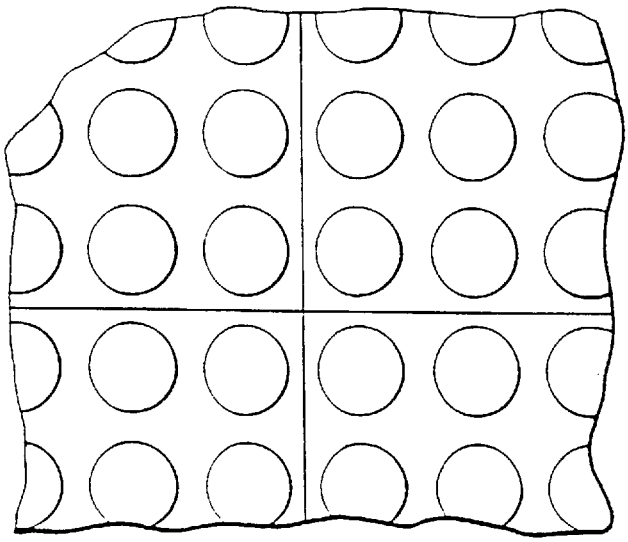
Figure 8:
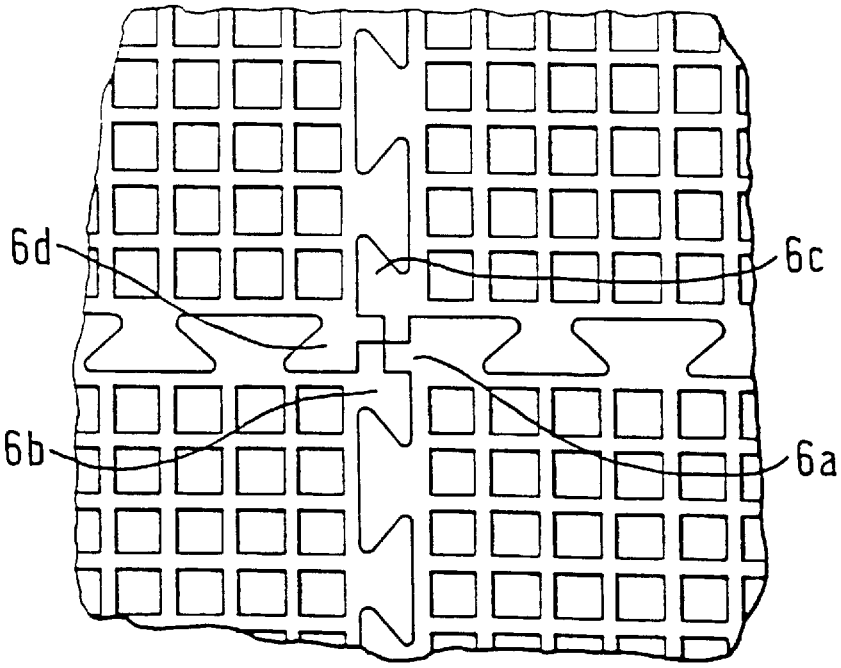
Figure 9:
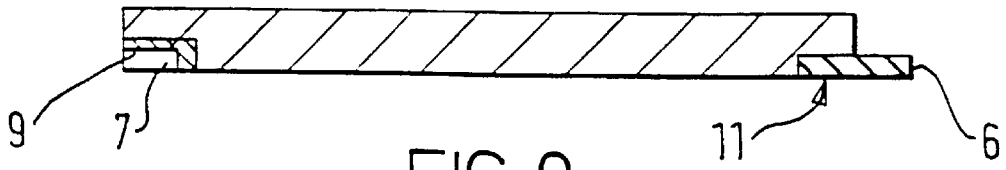
Figure 10:
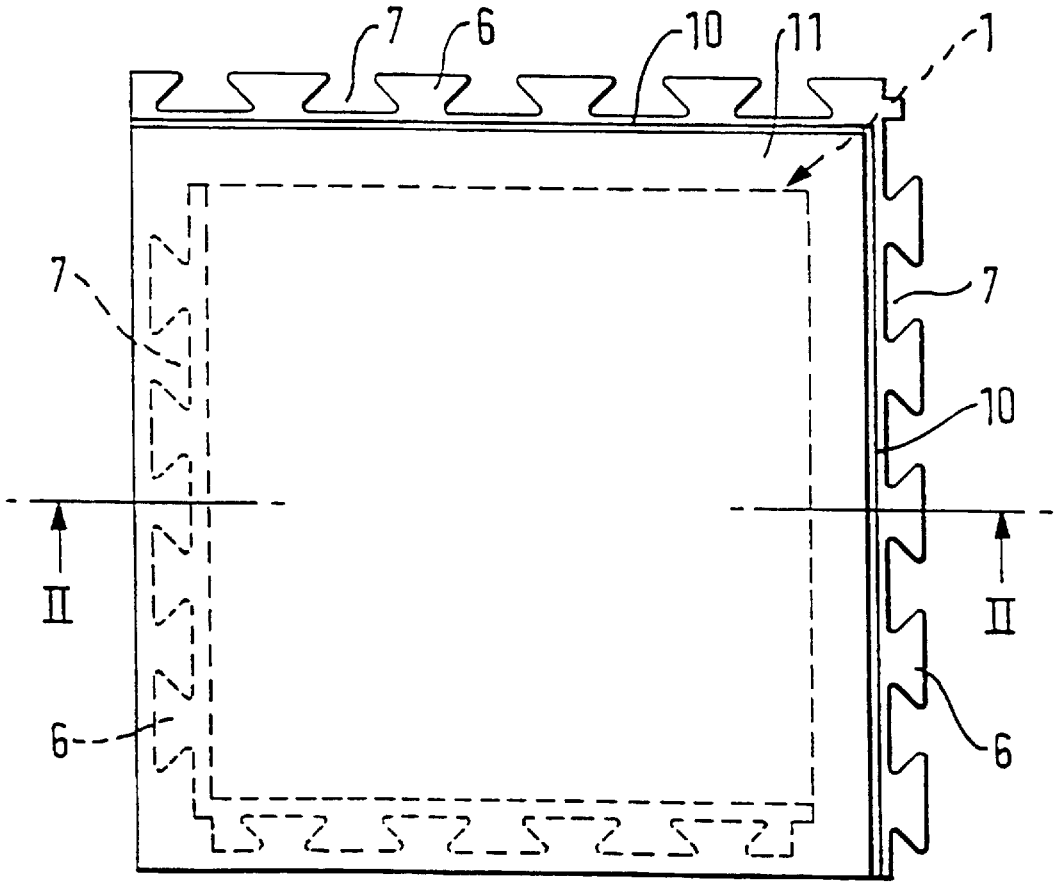

FIGS. 5 and 6 show the underside of a fragment of two tiles as shown in FIGS. 3 and 4, FIGS. 7 and 8 show a top view and an underneath view of four tiles connected together, FIG. 7 being the top side and FIG. 8 from the bottom side, FIG. 9 shows a cross-section through a second embodiment, and FIG. 10 shows a plan view of the second embodiment.

Figure 1:
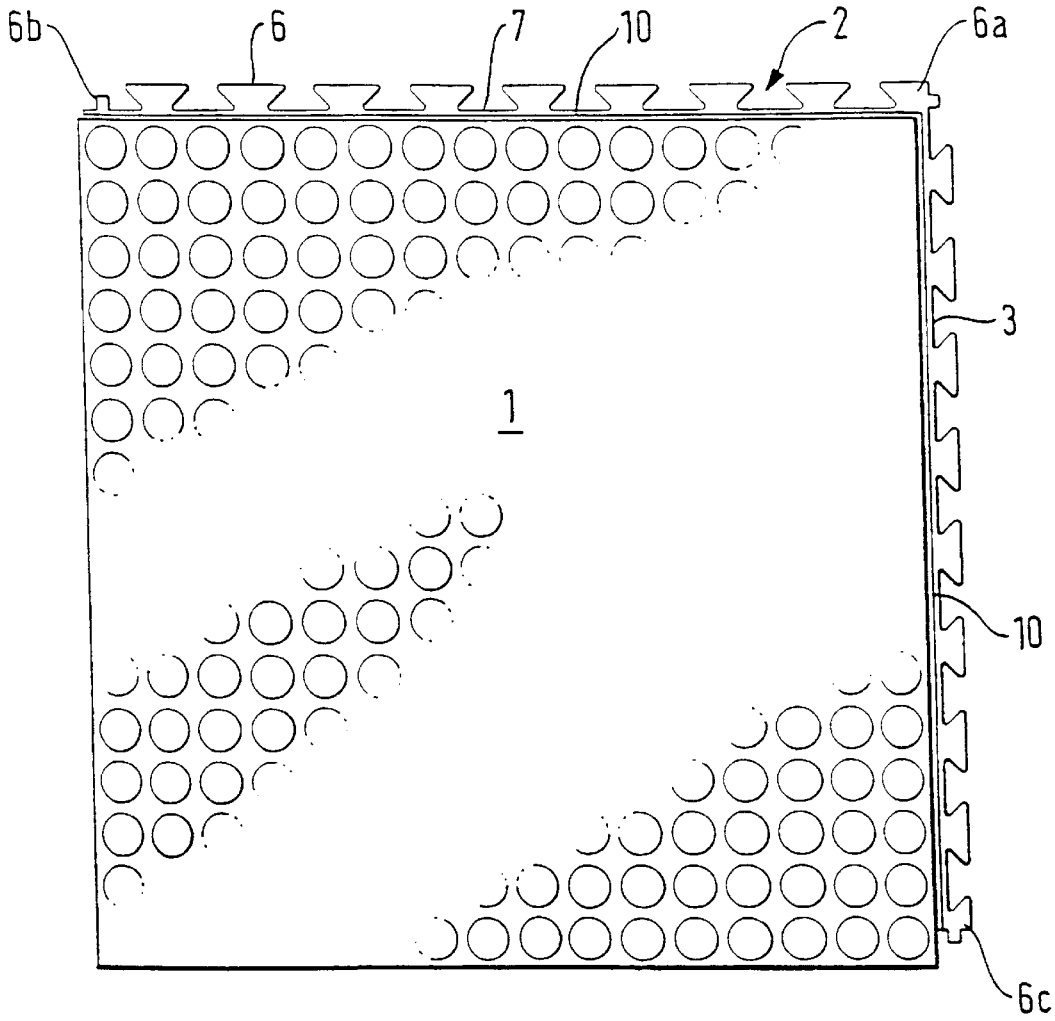
FIG. 1 shows a plan view of the upper side of a floor tile.

Referring now to FIG. 1, there is shown a floor tile formed of a synthetic plastics material with an upper surface 1 having a pattern of circles which, apart from being decorative, provide a substantially non-slip surface. Of course, many other types of decorative pattern may be provided. The upper surface is square in plan view and has two adjacent sides 2 and 3 carry engagement members 6 extending beyond the profile of the upper surface.

The two adjacent sides 2, 3 each have a plurality of engaging elements 6 extending therefrom. Each projecting engaging element consists, essentially, of an equilateral rhomboid having an outer edge which is substantially longer than its inner side at the root of the member where it joins the main body. Between adjacent engageable members, there is therefore a recess which consists of a mirror image of an engageable element so that the engageable elements 6 on an adjacent tile can be located in these recesses. In this embodiment, there are nine projecting elements 6 on each side.

In this embodiment, the elements 6 are approximately 4 mm in thickness and the overall thickness of the tile is approximately 6.7 mm. The thickness of the tile will be varied in dependence on the actual application. At the root of the elements 6, adjacent the upper surface, there is a slot 10 extending along the length of the sides 2, 3. At the ends of each side 2, 3 there are shaped extensions 6*a*, 6*b*, 6*c* which cooperate with corresponding extensions on adjacent tiles to complete the slots 10 along the complete lengths of the sides, as will be described hereinafter.

Figure 2:
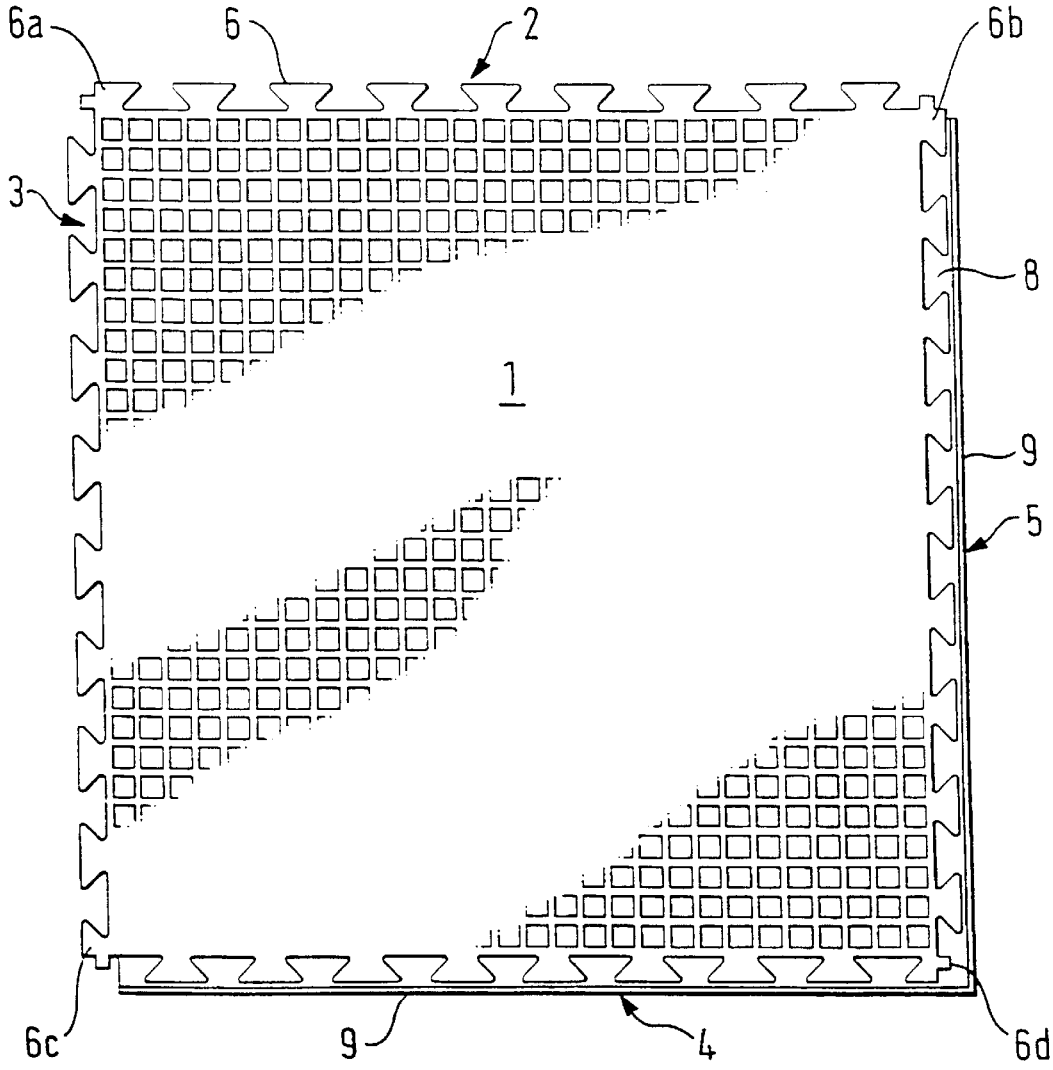
FIG. 2 shows the underside of the embodiment of FIG. 1.

Referring now to FIG. 2, there is shown the underside of the tile of FIG. 1. It can be seen that the two adjacent sides 4 and 5 have engagement elements 6. The upper surface 8 of the tile overlies the elements 6 and extends slightly further outwardly. On this outer extension, the tile has a rib 9 extending along the length of the side and extending downwardly perpendicularly away from the upper surface 1.

Referring now to FIGS. 3 to 6, there is shown a scrap view of the comers of two tiles to be joined together. FIG. 3 shows the top of the tiles about to be placed together and FIG. 4 shows them secured together. FIG. 5 shows the underside of the tiles corresponding to FIG. 3 and FIG. 6 shows the underside view corresponding to FIG. 4. It can be seen that the outwardly extending elements 6 on one tile engage with the elements 6 on the other tile which are covered by the upper surface. At the same time, the rib 9 engages with the slot 10 throughout the length of the side. In this way, a substantially fluid tight seal is formed between adjacent tiles.

Referring now to FIGS. 7 and 8, there is shown the junction between four juxtaposed tiles. It can be seen that the four corner extensions cooperate and abut closely to form a complete seal which results from the formation of a complete slot and rib in this region to thereby complete the seal round the edge of all adjacent tiles. It can thus be seen that the use of one design of tile which can interlock with an identical tile enables a floor of any size to be covered securely by tiles having a substantially liquid-tight seal at the joints between tiles.

The material of the tile will depend largely on the application, but may be vinyl, polyvinyl chloride, polypropylene or polyethylene. In a second embodiment, to be described with reference to FIGS. 9 and 10, the main body of the tile is formed of a rigid substance such as a ceramic material.

Referring now to FIGS. 9 and 10, there is shown a second embodiment in which FIG. 9 is a cross-section along the line II—II of FIG. 10. FIG. 10 is a plan view of the tile. The main body 1 of the tile is formed of a ceramic material with the engaging elements and recesses formed in a resilient seal or gasket which locates in a peripheral recess in the underside of the tile and extends round the periphery of the tile, to which it is preferably bonded. In other respects, the engaging elements and the recesses, ribs and slots are the same as the first embodiment.

It will be appreciated that many variations may be made to the tile without departing from the inventive concept. For example, the shape and number of the projecting elements 6 may differ; all that is required is that they mesh universally with other tiles of the same design. It is also possible to incorporate different facings on the upper surface, for example a ceramic layer. The tile may also be adapted for covering other surfaces such as roofing, walls, shower units etc., although it is particularly intended for heavy duty applications such as factories and operating theatres.

What is claimed is:

1. An interlocking, generally planar tile, having a four-sided, square, shape with an upper surface, a lower surface, a first side, a second side, a third side, and a fourth side, wherein each of said sides has a plurality of engagement elements interlockingly engageable with corresponding engagement elements on an adjacent tile, an adjacent first two of said sides having said upper surface extending over said engagement elements, an edge rib extending along the length of said adjacent first two of said sides and extending downwardly away from said upper surface, an adjacent second two of said sides having said engagement elements extending outwardly beyond said upper surface and having a recess extending along the length of said adjacent second two of said sides, which recess is adapted to receive a rib on a first side on an adjacent tile, the engagement of said rib in said recess forming a substantially fluid tight joint between the two tiles.

2. An interlocking, generally planar tile according to claim 1 wherein said tile is formed of a resilient material.

3. An interlocking, generally planar tile according to claim 1 wherein the main body of the tile is formed of a ceramic material and said engagement elements, rib, and recess are formed in a peripheral seal or gasket of resilient material extending round the periphery of said tile on said lower surface.

4. An interlocking, generally planar tile according to claim 3, wherein said recess is located at the root of said engaging elements immediately adjacent to the edge of said upper surface so that when an adjacent tile is placed adjacent to said tile, a rib on said adjacent tile engages in said recess so that said upper surface of said tile and an upper surface of said adjacent tile are closely abutting so as to substantially conceal the joint between said two tiles.

5. An interlocking, generally planar tile according to claim 4, wherein said tile is a floor tile.

6. An interlocking, generally planar tile according to claim 3, wherein said tile is a floor tile.

7. A. An interlocking, generally planar tile according to claim 1 wherein said tile is a floor tile.

8. An interlocking, generally planar tile according to claim 1, wherein said tile is formed of a material selected from the group comprising plastics, natural rubbers, and synthetic rubbers.

9. An interlocking, generally planar tile, having a four-sided, rectangular, shape with an upper surface, a lower surface, a first side, a second side, a third side, and a fourth side, wherein each of said sides has a plurality of engagement elements interlockingly engageable with corresponding engagement elements on an adjacent tile, an adjacent first two of said sides having said upper surface extending over said engagement elements, an edge rib extending along the length of said adjacent first two of said sides and extending downwardly away from said upper surface, an adjacent second two of said sides having said engagement elements extending outwardly beyond said upper surface and having a recess extending along the length of said adjacent second two of said sides, which recess is adapted to receive a rib on a first side on an adjacent tile, the engagement of said rib in said recess forming a substantially fluid tight joint between the two tiles.

* * * * *